United States Patent [19]

Richards

[11] Patent Number: 5,076,623

[45] Date of Patent: Dec. 31, 1991

[54] MAGNETICALLY OPERATED LATCH

[76] Inventor: Roger C. Richards, 8 Church Street, Amersham, Buckinghamshire, HP7 0DB, United Kingdom

[21] Appl. No.: 475,188

[22] Filed: Feb. 5, 1990

Related U.S. Application Data

[63] Continuation-in-part of Ser. No. 353,178, May 16, 1989, Pat. No. 4,919,464, which is a continuation of Ser. No. 92,942, Sep. 4, 1987, abandoned.

[51] Int. Cl.[5] ..... E05C 17/56

[52] U.S. Cl. ..... 292/251.5; 70/276; 292/341.16; 292/144; 292/201

[58] Field of Search ..... 70/413, 276; 292/251.5, 292/341.15, 341.17, 341.16

[56] References Cited

U.S. PATENT DOCUMENTS

| | | | |
|---|---|---|---|
| 2,797,655 | 7/1957 | Morehouse | 292/251.5 |
| 3,408,837 | 11/1968 | Felson | 70/276 |
| 3,605,459 | 9/1971 | Van Dalen | 292/144 |
| 3,611,763 | 10/1971 | Sedley | 70/276 |
| 3,837,525 | 9/1974 | Kobayashi | 292/144 |
| 3,967,479 | 7/1976 | Vick | 70/276 |
| 4,848,812 | 7/1989 | Slaughter | 292/251.5 |

FOREIGN PATENT DOCUMENTS

| | | | |
|---|---|---|---|
| 17997 | 7/1913 | France | 70/276 |
| 2182713A | 5/1987 | United Kingdom | 292/341.16 |

*Primary Examiner*—Eric K. Nicholson

*Attorney, Agent, or Firm*—Griffin, Branigan & Butler

[57] ABSTRACT

A magnetically operated latch includes one or two latching members, the or each member including a permanent magnet and being turnable or slidable between an engaging position and a disengaged position, and a further member of a magnetically soft material which attracts the magnet(s) to displace the latching member(s) into the engaging position(s). To disengage the latching member(s) a further magnet is brought to a position in which it acts repulsively on the permanent magnet(s) by way of the further member.

10 Claims, 3 Drawing Sheets

MAGNETICALLY OPERATED LATCH

This is a continuation-in-part of U.S. Ser. No. 07/353,178 filed on May 16, 1989 now U.S. Pat. No. 4,919,464 which in turn is a continuation of U.S. Ser. No. 092,942 filed on Sept. 4, 1987 and now abandoned.

BACKGROUND OF THE INVENTION

1. Field of the Invention

This invention relates to a magnetically operated latch.

2. Description of the Prior Art

A wide variety of magnetically operated locks and latches are known from, for example, U.S. Pat. Nos. 2,730,392; 3,495,425; 3,518,855; 3,596,958; 3,600,019; 3,641,793; 3,744,833; 3,785,188; 3,831,986; 3,837,195; 3,837,525 and 4,380,162; British Patents 586039; 1201160; 1580850 and 2145461; Danish Patent 73446 and Federal German Patent Publication 1036702.

U.S. Pat. No. 3,600,019 discloses a latch mechanism which is for slidable sashes and which can be locked in the latched position. The mechanism comprises a latching member which is mounted to be manually turned in a vertical plane for engagement with a keeper, a catch which is mounted to reciprocate in a path transverse to the plane and spring-biased to interengage with the latching member when the latter is engaged with the keeper, a catch release member which is mounted to reciprocate in a vertical path, and a bell-crank lever operative to retract the catch from the latching member against the action of the spring in response to upward movement of the catch release member. The latter is detained against upward movement by a first permanent magnet protruding into a bore therein from a bore in a block mounting the latching member. A second permanent magnet fixed in the inner end of the latter bore repels the first magnet into that detaining position. An actuator manually reciprocable in a vertical path can be raised to a position in which a third or external permanent magnet fixed thereto repels the first magnet into the bore in the block against the action of the second magnet and so allows the catch release member to be raised by that same actuator to retract the catch. Subsequent lowering of the actuator allows the second magnet to repel the first magnet to against an external surface of the release member. When the latching member is returned into its latched position, the action of the spring on the bell-crank lever reengages the catch and lowers the catch release member to enable the second magnet to repel the first magnet back into its detaining position. This mechanism is very complicated and is thus very costly.

U.S. Pat. No. 3,744,833 discloses a latch comprised of first and second permanent magnets mounted in mutually repelling relation upon a box so that the first is urged into an engaging position in which it engages in a recess in a cover of the box, and an external, third permanent magnet which when brought up to an outside wall of the box at a location close to the first magnet, which is vertically displaceable in an open-topped cavity in the wall, overcomes the repulsion and withdraws the first magnet. Upon removal of the third magnet, the repulsion between the first magnet and the second magnet, which is fixed to the inside of the box, returns the first magnet to its engaging position.

U.S. Pat. No. 2,730,392 discloses a secret magnetic locking device applicable to a variety of fields and comprising a bar, permanent magnet hidden in, for example a match book packet, and applicable to the outside surface of a box lid or cabinet panel. Turnably mounted about a pin fixed perpendicularly to one of the inside surfaces of the box or cabinet, for example the inside surface of the lid or panel is a latch bar containing a bar, permanent magnet extending parallelly to the inside surface. The latch bar has its permanent magnet at one end zone thereof, has its pin at an intermediate zone thereof and, at the other end zone thereof, is arranged to co-operate with a detent fixed to the lid or the panel, or to the body of the box or the cabinet, as the case may be. The manner in which the latch bar is brought into and out of its latched and unlatched positions is unclear. This latching device has a significant disadvantage in that the external magnet has to be employed both to displace the latch bar from its latched position to its unlatched position and to displace the bar from its unlatched position to its latched position. This has clear disadvantages in the everyday latching field where, for example with a medicine cupboard, it is important that its latching should be automatic and not require a further manipulation of the external magnet. Moreover, the need to manipulate the external magnet not only to unlatch the device but also to latch the device makes the overall operation of the device rather fiddly.

The devices of all of the U.S. Pat. Nos. 3,600,019; 3,744,833 and 2,730,392 have the disadvantage that the achievement of latching relies upon a single latching member being returned to its latching condition. If, for some reason, the single latching member fails to be returned to its latching condition upon removal of the external magnet, either temporarily or permanently, then the security intended to be achieved by the latching device is lost.

Federal German Auslegeschift 1036702 discloses a door cylinder lock wherein spring-loaded tumblers are brought into an unlocked position by means of respective external magnets. A housing encircles a cylinder formed with a key hole. A number of radial blind bores are formed in the internal surface of the housing and a corresponding number of blind bores are formed in the external surface of the cylinder, the latter bores being able to be brought into alignment with the former bores by turning of the cylinder about its axis relative to the housing. Two differeing tumbler arrangements are disclosed. In one, a bar, permanent magnet is urged, by a spring in the cylinder bore, into a locking condition in which it projects from the cylinder bore into the housing bore. To bring the tumbler into its non-locking condition, a key is inserted carrying a bar, permanent magnet which attracts the latching magnet out of the housing bore against the action of the spring. In the alternative arrangement, a tumbler comprised of magnetisable material is urged by a spring in the housing bore into a locking condition in which it projects from the housing bore into the cylinder bore and there bears against a bar, permanent magnet contained in the cylinder bore. To bring this tumbler into its non-locking condition, the key has a bar, permanent magnet which repels the bar, permanent magnet in the cylinder bore and thereby pushes the tumbler, against the action of the spring, into a position just outside the cylinder bore. Although, if one of the tumblers fails to lock, the other tumbler provides a back-up, this lock has the disadvantages that it uses springs, which can weaken or break, that it utilizes four magnets, which are expensive, and that the relative strengths of the magnets and the springs must be precisely determined at the manufacturing stage and must not change appreciably with use, since otherwise the tumblers can occupy locking conditions when they should be in their non-locking conditions or can occupy non-locking conditions when they should be in locking conditions.

U.S. Pat. No. 3,495,425 discloses a magnetically operating lock comprising a key cylinder and a coupling cylinder both of non-magnetic material and both retained in a housing, the key cylinder being freely rotatable in the housing, and the coupling cylinder being connected to a locking bail. Both cylinders have matching chambers, and coupling elements which are magnetic are located in the chambers. Upon insertion into the key cylinder of a key having predetermined zones of magnetization thereon, and if the zones of magnetization on the key match zones of magnetization on the respective coupling elements, the coupling elements will be magnetically repelled by the key and thereby move to span partly the two chambers, thus interconnecting the coupling cylinder and the key cylinder to permit operation of the locking bail by the key. Upon removal of the key, the coupling elements return to their initial condition by magnetically attracting each other. This is again a cylinder lock, which is relatively more complicated than a latch. Moreover, the lock requires predetermined zones of magnetization of the key to correspond with predetermined zones of magnetization of the coupling elements, which magnetization procedure is relatively expensive.

British Patent 1201160 discloses a magnetically operating lock similar to that of U.S. Pat. No. 3,295,425, but the coupling elements are returned to their initial condition by magnetic attraction to ferromagnetic elements in the key cylinder.

U.S. Pat. No. 3,596,958 discloses a magnetic lock which, in the preferred embodiment, is applied to a slide bar lock assembly comprised of an elongate bar and a slide mounted for movement therealong. The bar is formed with a plurality of sockets in spaced pairs along one face thereof, and the magnetic lock is employed for securing the slide at any selected position along the length of the bar in register with a pair of sockets. The magnetic lock includes a pair of locking magnets mounted in a pair of sockets formed in the inner face of the slide. The pair of sockets in the slide are adapted to register with a co-operating pair of sockets in the bar, by movement of the slide therealong. The slide carries a control magnet in the form of a bar, permanent magnet centrally mounted so as to be turnable relative to the slide and the bar about an axis parallel to the axes of the sockets in the slide and the bar. The poles of the locking magnets are inverted relative to each other, whereby the control magnet, in a first angular position of turning about its axis, will drive the locking magnets into a locking position in which they span the sockets in the slide and the aligned sockets in the bar and, in another angular position at 180° to the first, will retract the locking magnets completely into the sockets in the slide. Two keeper magnets also are mounted in recesses in the slide and serve to prevent the locking magnets from being jarred accidentally into an unlocked condition. By turning the control magnet into its first angular position, the locking magnets are repulsed downwardly into their locking positions. As the locking magnets reached their locking positions, the keeper magnets are drawn out of their recesses by the field of the control magnet and project into the base zones of the sockets in the slide, to prevent the locking magnets from moving back to the bases of those sockets until such time as the control magnet is returned to its second angular position. This is a somewhat complicated device and employs five magnets, and is thus relatively expensive.

U.S. Pat. No. 3,837,525 discloses a case including a tray with a cover which is telescopically engageable with the tray. The tray and the cover include interengageable latching members, namely two movable depending latches carried by the cover which are engageable with respective detents carried by the tray when the tray and the cover are telescopically engaged. The cover includes a recess designed to receive a magnet, which magnetically attracts the movable latches carried by the cover so that they are displaced out of engagement with the detents carried by the tray, to unlock the cover from the tray. The magnet is provided with a handle whereby it may be lifted into and out of the recess. The depending latches are urged into their latching conditions by respective springs, which is again a disadvantageous feature.

Moreover, it requires manipulation of the control magnet not only to bring the locking magnets into their non-locking conditions, but also to bring them into their locking conditions.

SUMMARY OF THE INVENTION

According to one aspect of the present invention, there is provided a latch comprising first and second latching means comprised of first and second permanent magnets, respectively, and displaceable between an engaging condition and a disengaged condition, and means of magnetic material arranged to attract said first and second permanent magnets and thus displace said first and second latching means into said engaging condition, the arrangement being such that magnet means can be brought into a position in which it acts repulsively upon said first and second permanent magnets to displace said first and second latching means into said disengaged condition.

According to a second aspect of the present invention, there is provided in combination, a latch comprising first and second latching means comprised of first and second permanent magnets, respectively, and displaceable between an engaging condition and a disengaged condition, and means of magnetic material arranged to attract said first and second permanent magnets and thus displace said first and second latching means into said engaging condition, the arrangement being such that magnet means can be brought into a position in which it acts upon said first and second permanent magnets to displace said first and second latching means into said disengaged condition, a first support upon which said first and second latching means are mounted, and a second support upon which said means of magnetic material is mounted, said latch serving to latch the first and second supports together against relative movement.

Owing to these aspects of the present invention, it is possible to employ only three permanent magnets in a magnetic latch having two independently engaging, latching members, and thereby not only to improve the security of the latching effect through having a plurality of latching members, but also to minimize the cost thereof.

According to a third aspect of the present invention, there is provided a latch comprising latching means comprised of a permanent magnet and displaceable between an engaging condition and a disengaged condition for mounting upon a first support, and means of magnetic material arranged to attract said permanent magnet and thus displace said latching means into said engaging condition for mounting upon a second support, said means of magnetic material and said latching means including respective engaging surface portions which engage each other in said engaging condition to retain said means of magnetic material and said latching means and thus the first and second supports against movement relative to each other, the arrangement being such that magnet means can be brought into a position in which its magnetic flux field acts by way of said means of magnetic material upon said permanent magnet to displace said latching means into said disengaged condition.

According to a fourth aspect of the present invention, there is provided in combination, a latch comprising latching means comprised of a permanent magnet and displaceable between an engaging condition and a disengaged condition, and means of magnetic material arranged to attract said permanent magnet and thus displace said latching means into said engaging condition, said means of magnetic material and said latching means including respective engaging surface portions which engage each other in said engaging condition to retain said means of magnetic material and said latching means against movement relative to each other, the arrangement being such that magnet means can be brought into a position in which its magnetic flux field acts by way of said means of magnetic material upon said permanent magnet to displace said latching means into said disengaged condition, a first support upon which said latching means is mounted, and a second support upon which said means of magnetic material is mounted, said latch serving to latch the first and second supports together against relative movement.

Owing to these aspects of the present invention, it is possible to simplify magnetically operated latches, because the flux-transmitting means serves as the detent for the latching means.

BRIEF DESCRIPTION OF THE DRAWINGS

For a better understanding of the invention and to show how the same may be carried into effect, reference will now be made, by way of example, to the accompanying drawings, in which.

DESCRIPTION OF THE PREFERRED EMBODIMENTS

Figure 1:
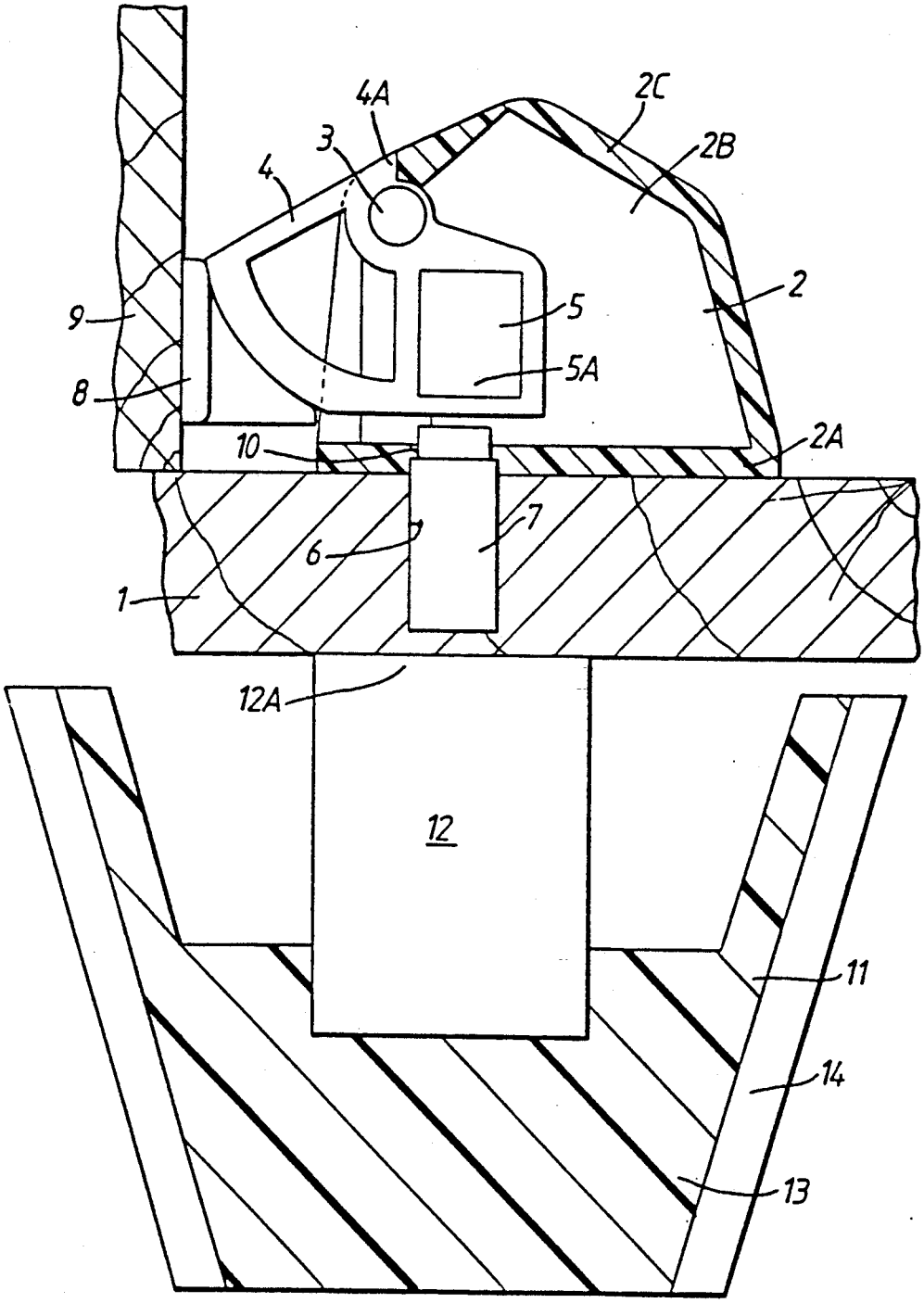
FIG. 1 shows a diagrammatic horizontal sectional view of a magnetically operated latch for latching a door leaf to a door jamb.

FIG. 1 shows a magnetically operated latch designed to be fixed to door leaves of, for example, articles of furniture. The latch is shown attached to a door leaf 1 and includes a body 2 secured by screws to the door leaf 1, the body 2 housing an extendable latching member 4 that is turnable within the body 2 about a vertical axis 3 so as to be able to extend from (as shown) or be withdrawn into the body 2.

The member 4 fixedly carries at one end a driving member 5 in the form of a permanent magnet and can releasably engage with its other end against an abutment 8 fixed to the door jamb 9. The body 2 comprises a vertical base wall 2A, two horizontal side walls (of which one is seen and referenced 2B) and a vertical shielding wall 2C. The member 4 is turnably mounted with plain bearings in the respective walls 2B and is formed with a detent 4A for abutting against the wall 2C to limit the degree of turning of the member 4 clockwise about the axis 3 in its latching position shown. Fitted co-axially in a drilled bore 6 in the leaf 1 is a rod 7 of magnetically soft material, in this case mild steel, shouldered at its inner end to fit into a shouldered bore 10 in the wall 2A. One pole 5A of the member 5 is arranged face-to-face with that inner end at a spacing therefrom and urges the member 4 into its latching position shown. A magnetic key 11 in the form of a permanent magnet 12 mounted in a plastics handle 13 formed with fluting 14 for gripping by the user's fingers and thumb has its exposed pole 12A of the same polarity as the pole 5A. Therefore, when the magnetic key 11 is applied in the vicinity of the rod 7 as shown, on the outside of the door leaf 1, the member 5 is magnetically repelled away from the magnetic key 11 and this turns the member 4 anticlockwise until it is withdrawn into the body 2. The magnetic attraction between the rod 7 and the magnet 12 is sufficient to enable the key 11 to remain adhered to the door leaf, while the leaf is opened using a handle (not shown).

When the magnetic key 11 is removed from the vicinity of the rod 7, the member 5 will be attracted back towards the rod 7, thereby returning the latch to the latching condition shown.

Apart from the two magnets illustrated and the rod 7, all other parts of the latch are made of non-magnetic material (aluminum, brass, plastics material etc.,).

The magnetic key 11 is designed so that the pole 12A is the more naturally applied to the door leaf by the user.

Figure 2:
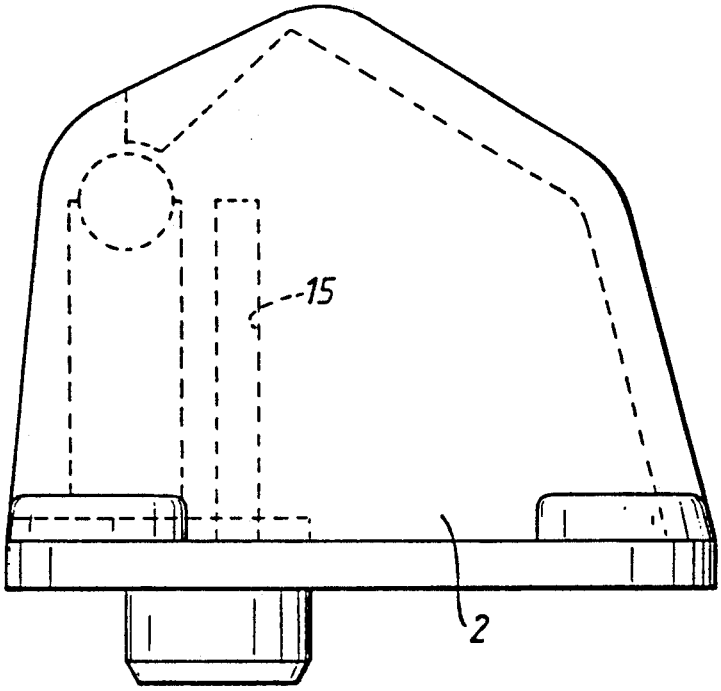
FIG. 2 shows a plan view of a body of a modified version of the latch.
Figure 3:
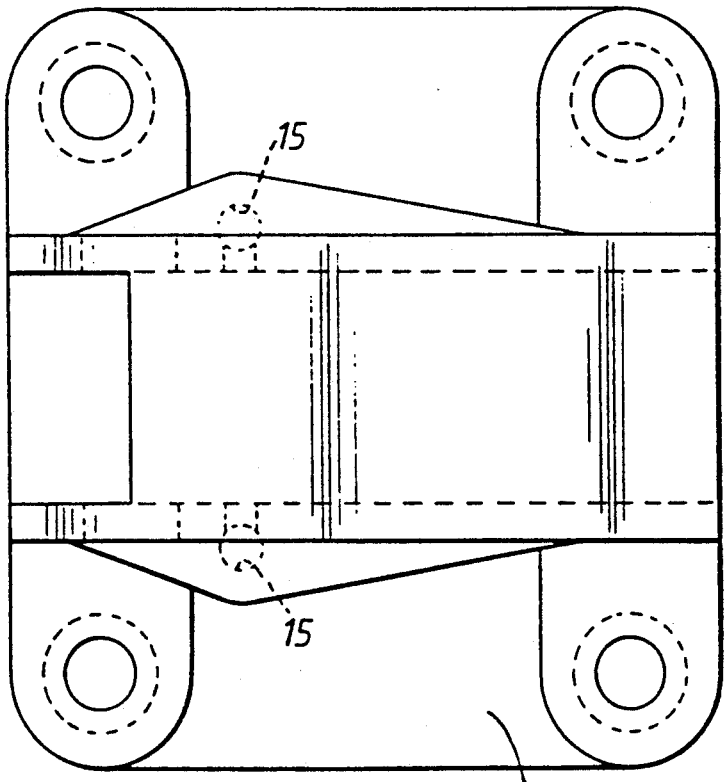
FIG. 3 shows a rear elevation of that body.

The version shown in FIGS. 2 and 3 differs from that shown in FIG. 1 in that the horizontal walls (2B) are formed with respective horizontal bores 15 which fittingly receive respective rods of magnetically soft material which extend from the inner end zone of the rod 7 along respective opposite sides of the magnet 5, in order to reinforce the magnetic repulsion and attraction effects on the magnet 5.

Figure 4:
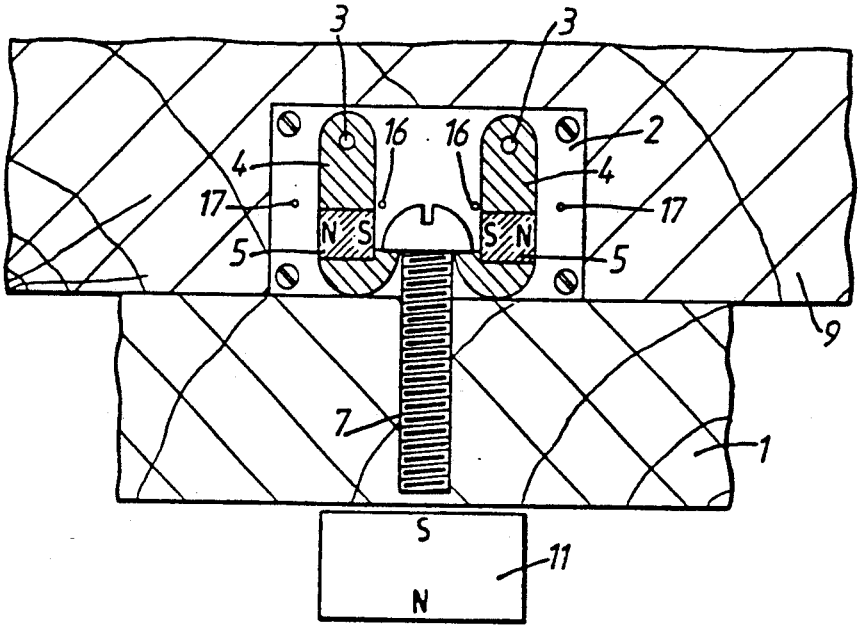
FIG. 4 is a view similar to FIG. 1 of another modified version of the latch.

In the version shown in FIG. 4, there are two latching members 4 each of hook form and turnable about respective vertical axes within limits set by stops 16 and 17 on a body 2 which, in this case, is fixed in a recess in the jamb 9. The hooked ends of the members 4 are of non-magnetic material and are arranged to engage behind the head of a magnetically soft member 7 in the form of a screw. The members 4 include respective permanent magnets 5 which are attracted towards the member 7, except when the magnet 11 is appropriately applied to the leaf 1 to repel the magnets 5 and thus turn the members 4 out of engagement with the screw 7 to allow the leaf 1 to be opened. Those two poles of the magnets 5 directed towards each other tend to repel each other in the absence of the screw 7 from therebetween. Near the end of closing of the leaf 1, with the magnet 11 absent, the head of the screw 7 pushes aside the hooked ends of the member 4, which hooked ends then engage behind the head.

Figure 5:
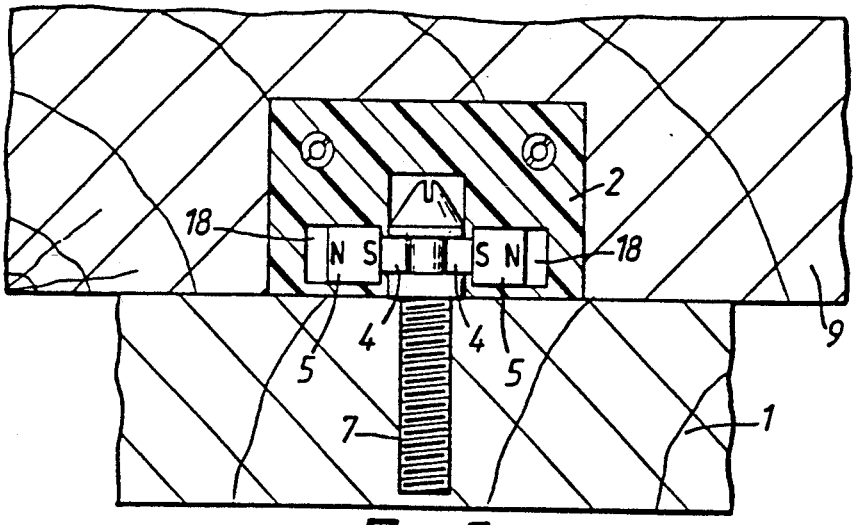
FIG. 5 is a view similar to FIG. 1 of a further modified version of the latch.

The version shown in FIG. 5 differs from that shown in FIG. 4 in that the members 4 including the magnets 5 are linearly guided in horizontal bores in the body 2, which is resiliently mounted in the jamb 9 to cope with tolerances desired during fitting of the latch to the leaf 1 and the jamb 9. Each member 4 engages in a recess in the side of the head of the screw 7 screwed into the leaf 1.

Figure 6:
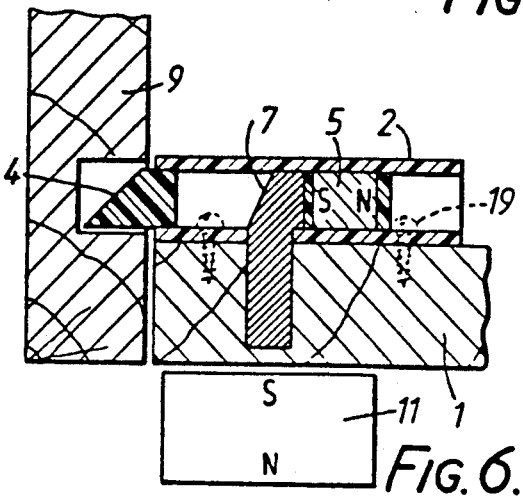
FIG. 6 is a view similar to FIG. 1 of a yet further modified version of the latch.
Figure 7:
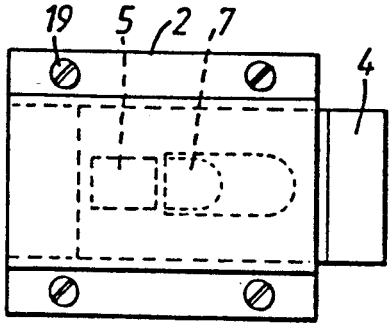
FIG. 7 is a view similar to FIG. 3 of that yet further modified version.

The version shown in FIGS. 6 and 7 differs from that shown in FIG. 1 chiefly in that the latching member 4 is linearly guided slidingly in the body 2, which is attached by screws 19 to the leaf 1. The magnet 5 is again separated from the member 7 by non-magnetic material of the member 4.

It will be appreciated that the present latch provides a child-proof safety lock in the kitchen and throughout the house on such furniture as would be defaced if a conventional lock with key hole etc., were fitted. In addition, the latch is useful wherever it is necessary to conceal the whereabouts of a locked leaf, such as a ceiling panel or a door, the magnetic key only remaining adhering to the outside of the leaf for as long as it is required to keep the leaf unlatched.

I claim:

1. A latch comprising latching means comprised of a permanent magnet and displaceable between an engaging condition and a disengaged condition for mounting upon a first support, and means of magnetic material arranged to attract said permanent magnet and thus displace said latching means into said engaging condition for mounting upon a second support, said means of magnetic material and said latching means including respective engaging surface portions which mechanically interlock with each other in said engaging condition to retain said means of magnetic material and said latching means and thus the first and second supports mechanically against movement relative to each other, the arrangement being such that magnet means can be brought into a position in which its magnetic flux field acts by way of said means of magnetic material upon said permanent magnet to displace said latching means into said disengaged condition.

2. A latch according to claim 1, wherein said means of magnetic material comprises a headed elongate member behind the head of which said latching means engages said elongate member.

3. In combination, a latch comprising latching means comprised of a permanent magnet and displaceable between an engaging condition and a disengaged condition, and means of magnetic material arranged to attract said permanent magnet and thus displace said latching means into said engaging condition, said means of magnetic material and said latching means including respective engaging surface portions which mechanically interlock with each other in said engaging condition to retain said means of magnetic material and said latching means mechanically against movement relative to each other, the arrangement being such that magnet means can be brought into a position in which its magnetic flux field acts by way of said means of magnetic material upon said permanent magnet to displace said latching means into said disengaged condition, a first support upon which said latching means is mounted, and a second support upon which said means of magnetic material is mounted, said latch serving to latch the first and second supports together against relative movement.

4. A combination according to claim 3, wherein said means of magnetic material comprises a headed elongate member behind the head of which said latching means engages said elongate member.

5. A latch comprising first and second latching means comprised of first and second permanent magnets, respectively, and displaceable between an engaging condition and a disengaged condition, means of magnetic material arranged to attract said first and second permanent magnets and thus displace said first and second latching means into said engaging condition, and first and second pivot means pivotally mounting said first and second latching means, respectively, for turning, about first and second axes, respectively, between said engaging condition and said disengaged condition, the arrangement being such that magnet means can be brought into a position in which it acts upon said first and second permanent magnets to displace said first and second latching means into said disengaged condition.

6. A latch comprising first and second latching means comprised of first and second permanent magnets, respectively, and displaceable between an engaging condition and a disengaged condition, and means of magnetic material arranged to attract said first and second permanent magnets and thus displace said first and second latching means into said engaging condition, said means of magnetic material and each of said first and second latching means including respective engaging surface portions which mechanically interlock with each other in said engaging condition to retain said means of magnetic material and each of said first and second latching means mechanically against relative movement away from each other, the arrangement being such that magnet means can be brought into a position in which it acts upon said first and second permanent magnets to displace said first and second latching means into said disengaged condition.

7. In combination, a latch comprising first and second latching means comprised of first and second permanent magnets, respectively, and displaceable between an engaging condition and a disengaged condition, and means of magnetic material arranged to attract said first and second permanent magnets and thus displace said first and second latching means into said engaging condition, said means of magnetic material and each of said first and second latching means including respective engaging surface portions which mechanically engage each other in said engaging condition to retain said means of magnetic material and each of said first and second latching means mechanically against relative movement away from each other, the arrangement being such that magnet means can be brought into a position in which it acts upon said first and second permanent magnets to displace said first and second latching means into said disengaged condition, a first support upon which said first and second latching means are mounted, and a second support upon which said means of magnetic material is mounted, said latch serving to latch the first and second supports together against relative movement.

8. In combination, a latch comprising first and second latching means comprised of first and second permanent magnets, respectively, and displaceable between an engaging condition and a disengaged condition, and means of magnetic material arranged to attract said first and second permanent magnets and thus displace said first and second latching means into said engaging condition, said first and second permanent magnets having respective like poles directed towards each other, said means of magnetic material being interposed between said like poles in said engaging condition, and said permanent magnets repelling each other when said means of magnetic material is no longer interposed therebetween, the arrangement being such that magnet means can be brought into a position in which it acts upon said first and second permanent magnets to displace said first and second latching means into said disengaged condition, a first support upon which said first and second latching means are mounted, and a second support upon which said means of magnetic material is mounted, said latch serving to latch the first and second supports together against relative movement.

9. A latch comprising first and second latching means comprised of first and second permanent magnets, respectively, and displaceable between an engaging condition and a disengaged condition, and means of magnetic material arranged to attract said first and second permanent magnets and thus displace said first and second latching means into said engaging condition, said first and second permanent magnets having respective like poles directed towards each other, said means of magnetic material being interposed between said like poles in said engaging condition, and said permanent magnets repelling each other when said means of magnetic material is no longer interposed therebetween, the arrangement being such that magnet means can be brought into a position in which it acts upon said first and second permanent magnets to displace said first and second latching means into said disengaged condition.

10. A combination according to claim 7, wherein said means of magnetic material comprises a headed elongate member behind the head of which said first and second latching means engage said elongate member.

* * * * *